US007685949B2

(12) United States Patent
Huang

(10) Patent No.: US 7,685,949 B2
(45) Date of Patent: Mar. 30, 2010

(54) FEEDING DOOR OF HEAT TREATMENT FURNACE

(76) Inventor: Ho-Kuei Huang, 12, Lane 307, Chung Hu Street, Ying Ko, Taipei Hsien (TW)

( * ) Notice: Subject to any disclaimer, the term of this patent is extended or adjusted under 35 U.S.C. 154(b) by 388 days.

(21) Appl. No.: 11/635,573

(22) Filed: Dec. 8, 2006

(65) Prior Publication Data

US 2008/0134947 A1 Jun. 12, 2008

(51) Int. Cl.
*F23M 7/00* (2006.01)
*F24C 15/04* (2006.01)

(52) U.S. Cl. ..... 110/173 C; 110/173 R; 126/190

(58) Field of Classification Search ..... 110/173 R, 110/173 C, 176, 177; 126/190, 191, 194; 48/124; 160/210, 207, 213; 432/250; 266/249
See application file for complete search history.

(56) References Cited

U.S. PATENT DOCUMENTS 2,043,490 A * 6/1936 Redrup ..... 160/191
3,707,130 A * 12/1972 Reiner et al. ..... 110/173 R
3,811,396 A * 5/1974 Wessel et al. ..... 114/201 R
4,193,439 A * 3/1980 Kummerman ..... 160/188
4,668,899 A * 5/1987 Ide et al. ..... 318/280
6,074,206 A * 6/2000 Lauersdorf ..... 432/251
6,125,773 A * 10/2000 Coble ..... 110/176
6,695,390 B2 * 2/2004 Bucco Morello ..... 296/186.4
7,089,989 B2 * 8/2006 Pfender ..... 160/195

* cited by examiner

*Primary Examiner*—Kenneth B Rinehart
*Assistant Examiner*—David J Laux

(57) ABSTRACT

A feeding door of a heat treatment furnace comprises a box, at least a starter, and a door plank. The door plank is pivotally coupled with the front side of the box. The door plank is consisted of at least two pivotally coupled door plates. The box has a chamber for holding an object that waits for drying. The box has at least a breach. The door plank is pivotally coupled with the box above the breach. The starter is fixed on an outer lateral of the box. The starter has a hydraulic cylinder for connection with the box and the door plank via both ends so as to upward or downward shift the door plank by an adjustable rod of the hydraulic cylinder. Accordingly, it is more flexible to configure the overall space so as to achieve the purposes of saving space and manpower and provide the material-feeding convenience.

4 Claims, 10 Drawing Sheets

FEEDING DOOR OF HEAT TREATMENT FURNACE

FIELD OF THE INVENTION

The present invention relates to a feeding door of a heat treatment furnace, and more particularly to a feeding door of a heat treatment furnace capable of automatically upward or downward shifting the door plank by an adjustable rod of a hydraulic cylinder so as to achieve the purposes of saving space, manpower, and time and provide the material-feeding convenience.

BACKGROUND OF THE INVENTION

As shown in FIG. 1, the general heat treatment furnace has a single-plate or a double-plate feeding door on the exit, wherein the door plank is push-shifted to the lateral of the heat treatment furnace via pulleys. After shifting an object that waits for drying into the heat treatment furnace, the exit of the heat treatment furnace is closed and then heated for preforming the heat treatment process.

In accordance with the aforesaid door-open manner, the both sides of the exit of the heat treatment furnace must be vacated by a certain space so as to open or close the door plank normally. If the heat treatment furnace is huge in size, the vacated space on both sides of the exit of the heat treatment furnace must be correspondingly increased. As a result, it causes a waste of large space. In addition, the flexibility of configuring the overall space is thus reduced, and the factory rent cost is relatively increased.

SUMMARY OF THE INVENTION

A major object of the present invention is to provide a feeding door of a heat treatment furnace that upward or downward shifts the door plank by an adjustable rod of a hydraulic cylinder so as to configure the overall space flexibly and achieve the purposes of saving space, manpower, and delivery time.

In order to achieve the aforesaid object, a feeding door of a heat treatment furnace comprises a box, at least a starter, and a door plank. The door plank is pivotally coupled with the front side of the box. The box has a chamber and at least a breach. The door plank is pivotally coupled with the box above the breach. The starter is fixed on an outer lateral of the box so as to shift the door plank upward or downward.

The door plank is consisted of several door plates so that the door plank is more complete and rigid. As a result, the door plank can be enlarged and widened. Accordingly, it is more flexible to configure the overall space so as to achieve the purpose of saving space, manpower, and time and provide the material-feeding convenience.

DETAILED DESCRIPTION OF THE PREFERRED EMBODIMENT

Figure 1:
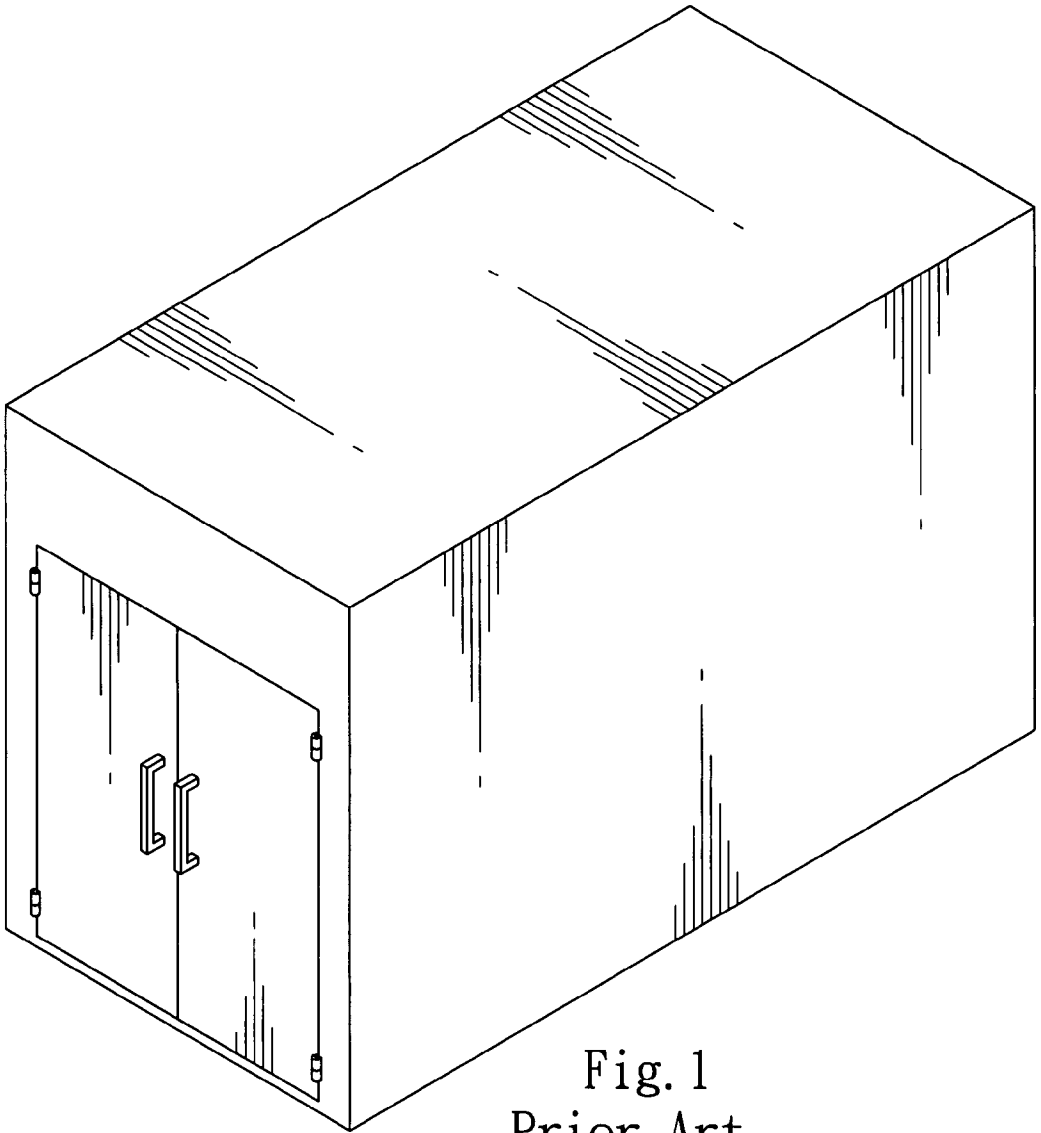
Fig. 1 Prior Art
FIG. 1 is an elevational view showing a conventional feeding door of a heat treatment furnace.
Figure 2:
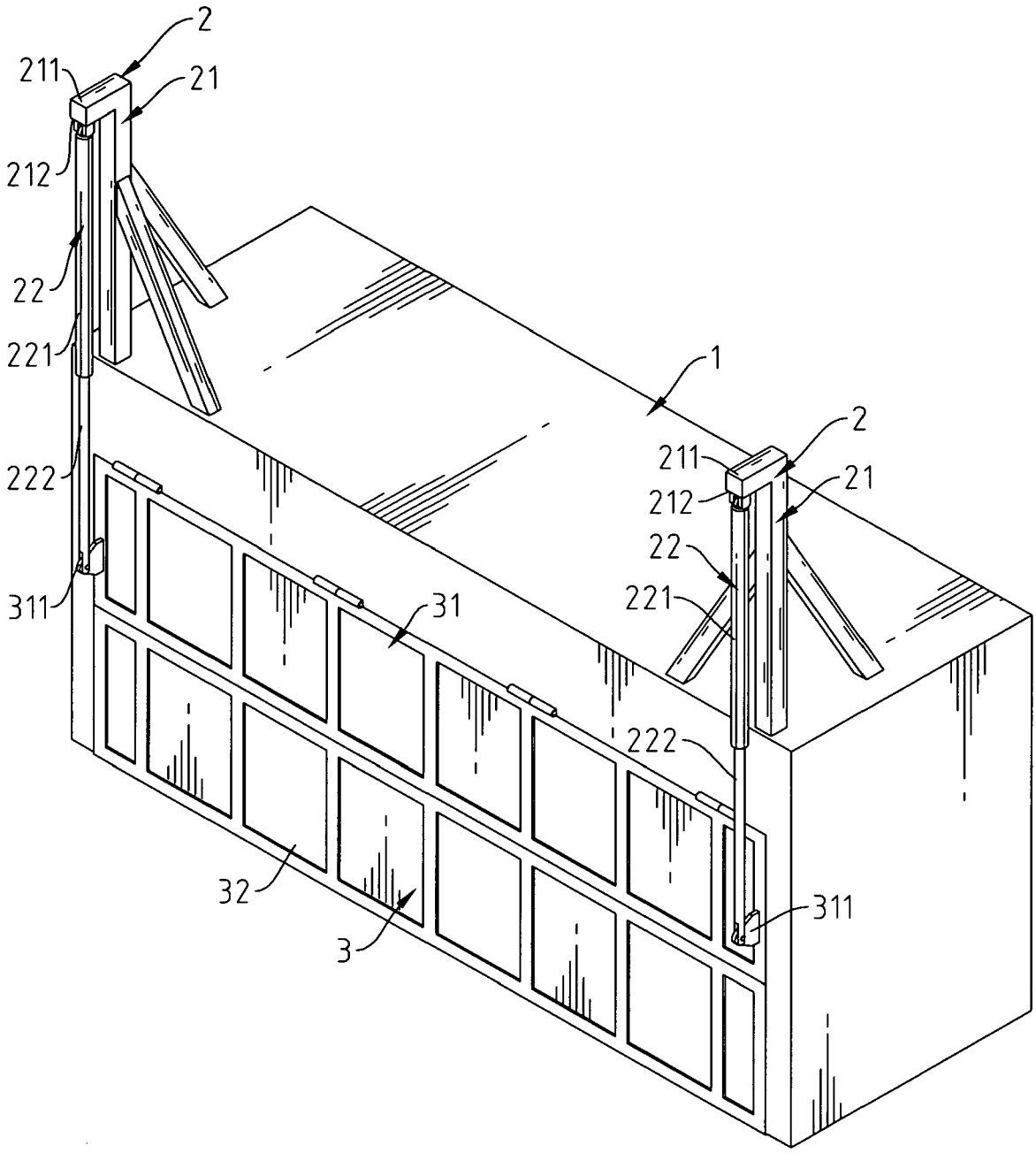
FIG. 2 is an elevational view showing a first preferred embodiment of the present invention.

Referring to FIG. 2, a first preferred embodiment of the present invention is shown. A feeding door of a heat treatment furnace generally comprises a box 1, a starter 2, and a door plank 3.

The box 1 has a chamber formed therein for holding an object that waits for drying. In addition, the box 1 has at least a breach 11. The door plank 3 is pivotally coupled with the box 1 above the breach 11. In addition, at least a starter 2 is mounted on the outer lateral of the box 1. Furthermore, the box 1 can be made by processing a general container.

The starter 2 has a support frame 21 and a hydraulic cylinder 22, wherein the support frame 21 is fixed on the outer lateral of the box 1 corresponding to the door plank 3. In addition, the support frame 21 has a protrudent part 211 protruding forward from the top end thereof. The protrudent part 211 has a downward-facing bottom surface 212. The bottom surface 212 is pivotally connected with the hydraulic cylinder 22. The hydraulic cylinder 22 has a main body 221 and an adjustable rod 222 movably mounted in the main body 221. The bottom surface 212 is pivotally connected with one end of the main body 221. The one end of the adjustable rod 222 is pivotally connected with the outer lateral surface of the door plank 3.

The door plank 3 is formed by pivotally coupling a first door plate 31 and a second door plate 32. The first door plate 31 is pivotally connected with the box 1 above the breach 11. In addition, the first door plate 31 has several protrudent ears 311 on the proper positions under the transverse centerline, wherein the number of the protrudent ears is consistent with that of the starter 2. The protrudent ears 311 are pivotally connected with one end of the adjustable rod 222 of the hydraulic cylinder 22. The door plank 3 can be formed by pivotally coupling several door plates.

Figure 3:
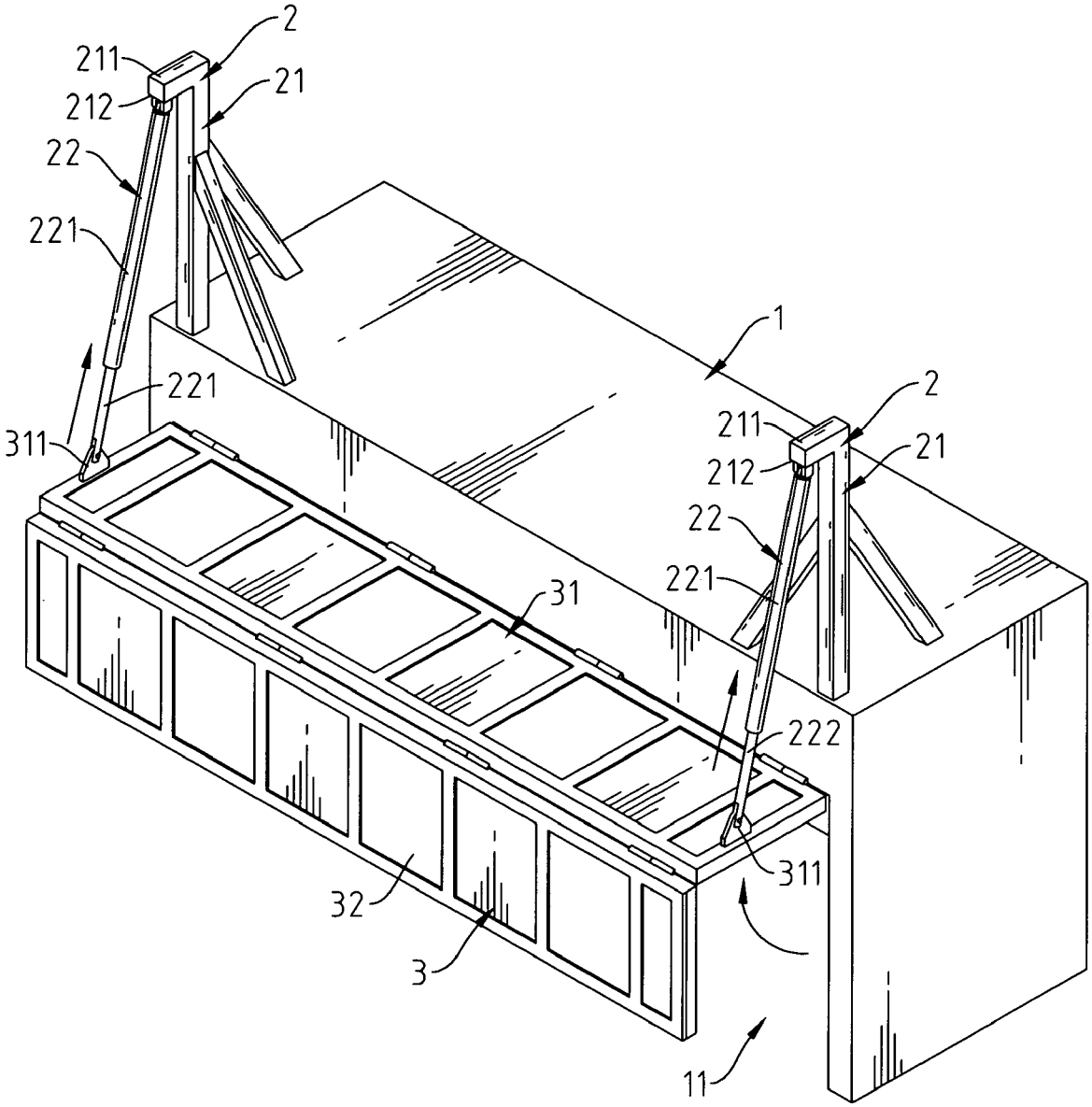
FIG. 3 is a schematic view showing the half-open status of the door plank in accordance with the first preferred embodiment of the present invention.
Figure 4:
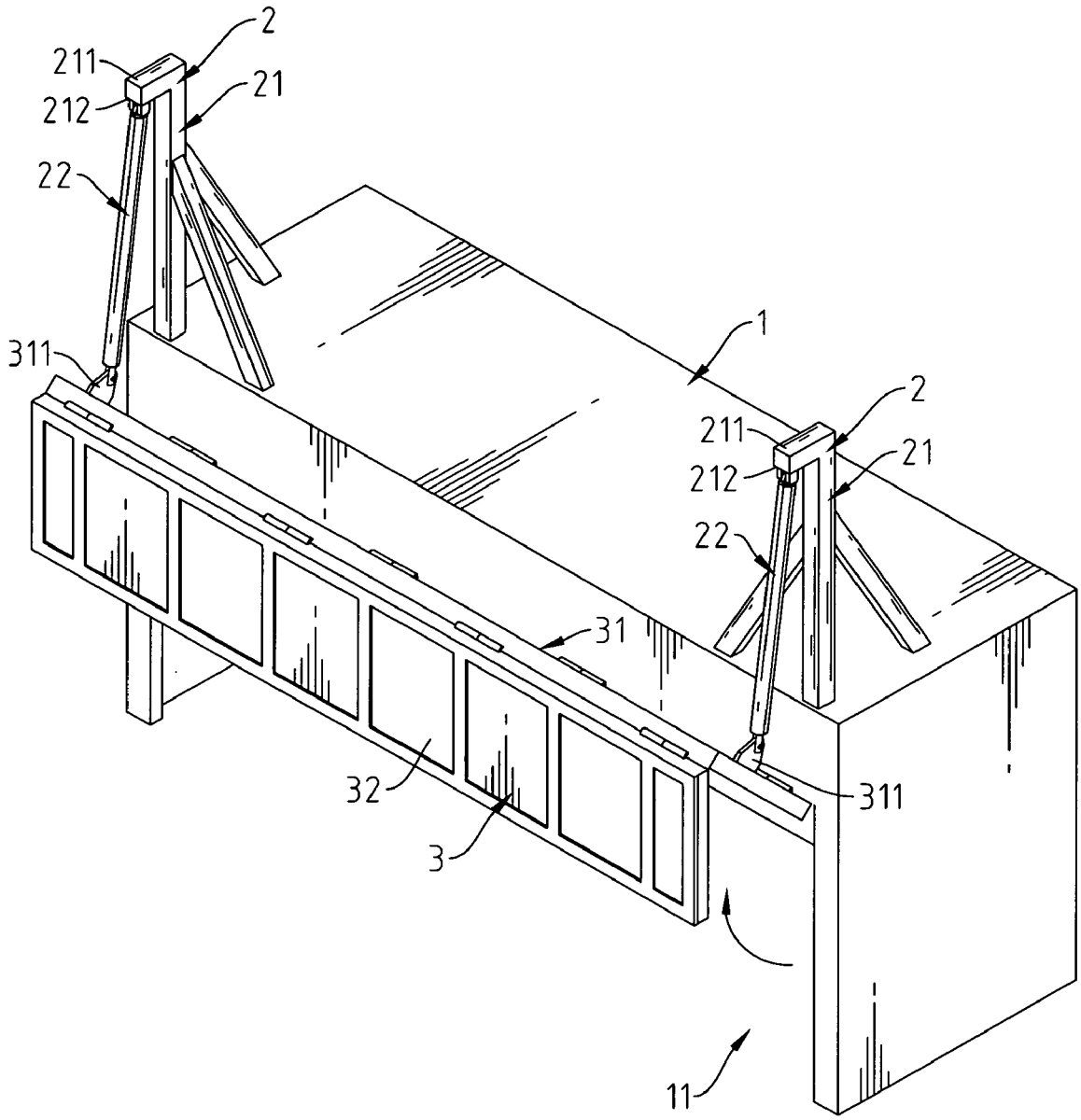
FIG. 4 is a schematic view showing the full-open status of the door plank in accordance with the first preferred embodiment of the present invention.

Referring to FIG. 3 and FIG. 4, these diagrams are schematic views showing the usage status of the feeding door of the heat treatment furnace of the present invention. When in use, the hydraulic cylinder 22 is started so as to shift the door plank 3 by using the adjustable rod 222. If the adjustable rod 222 is upward shortened, the first door plate 31 can be lifted up by the protrudent ears 311, wherein the first door plate 31 can drive the second door plate 32 to be suspended vertically and then folded inwardly so that the door plank 3 can be opened. On the contrary, if the adjustable rod 222 of the hydraulic cylinder 22 is downward shifted, the door plank 3 can be closed downward. As a result, the step for opening or closing the door plank does not limited by the available space on both sides of the door plank. Accordingly, it is more flexible to configure the overall space so as to achieve the purpose of saving space.

Figure 5:
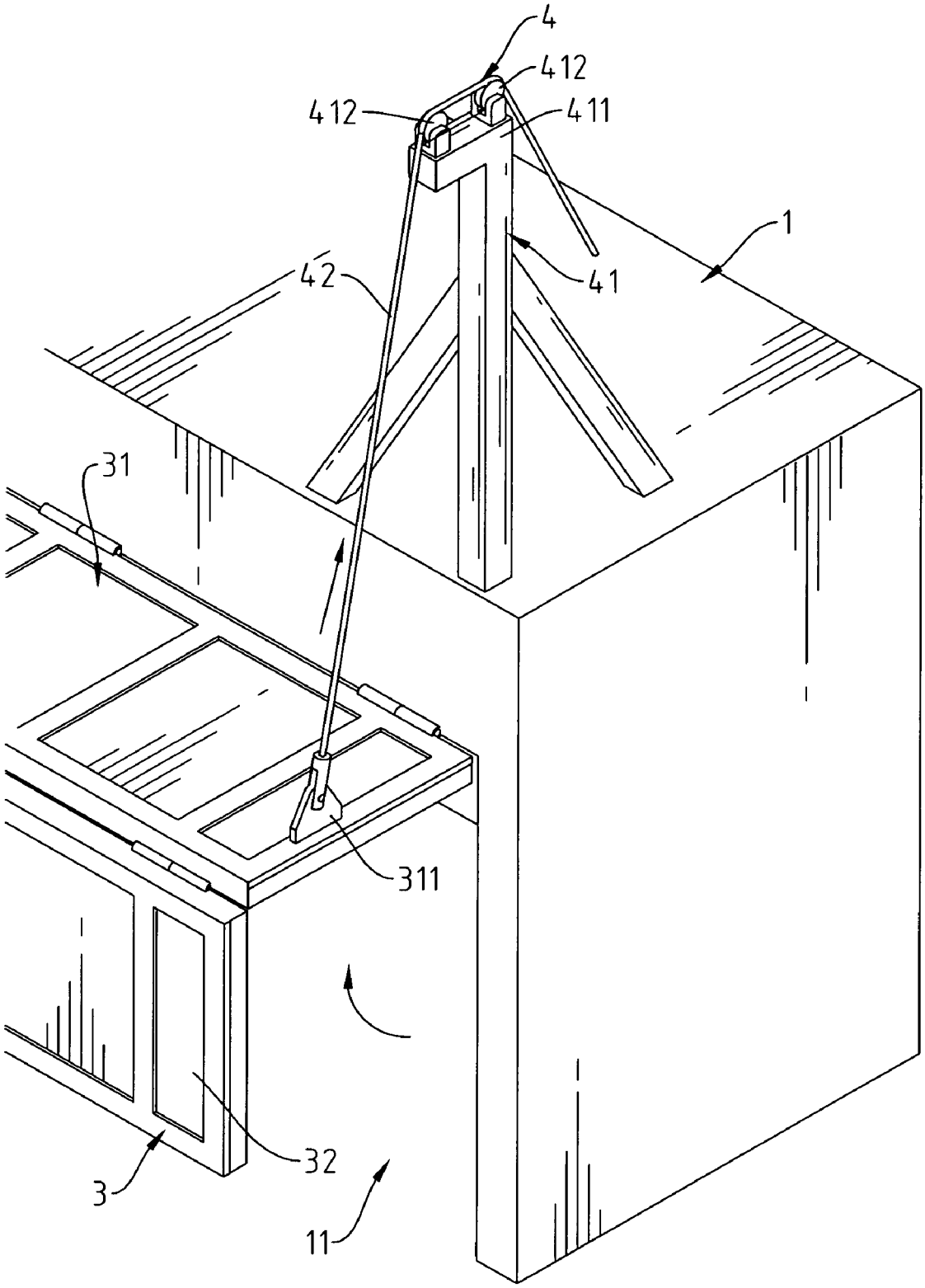
FIG. 5 is a schematic view showing the usage status of a second preferred embodiment of the present invention.

Referring to FIG. 5, a second preferred embodiment of the present invention is shown. A feeding door of a heat treatment furnace comprises a box 1, a starter 4, and a door plank 3. The starter 4 has a support frame 41 and a steel rope 42, wherein the support frame 41 is fixed on the outer lateral of the box 1 corresponding to the door plank 3. In addition, the support frame 41 has a protrudent part 411 protruding forward from the top end thereof. At least a rotation wheel is coupled to the upper portion of the protrudent part 411, wherein in this preferred embodiment, the rotation wheel is a pulley 412 for being correspondingly rotated by a linear connection device. In this preferred embodiment, the linear connection device is the steel rope 42, wherein one end of the steel rope 42 is pivotally connected to the protrudent ears 311. The other end of the steel rope 42 is connected to a winding device (not shown).

Referring to FIG. 5, the usage status of the second preferred embodiment of the present invention is shown. When in use, a winding device (not shown) is started so as to reach the upward pull motion. The steel rope 42 is utilized to lift up the first door plate 31 via the protrudent ears 311, wherein the first door plate 31 can drive the second door plate 32 to be suspended vertically and then folded inwardly so that the door plank 3 can be opened.

Figure 6:
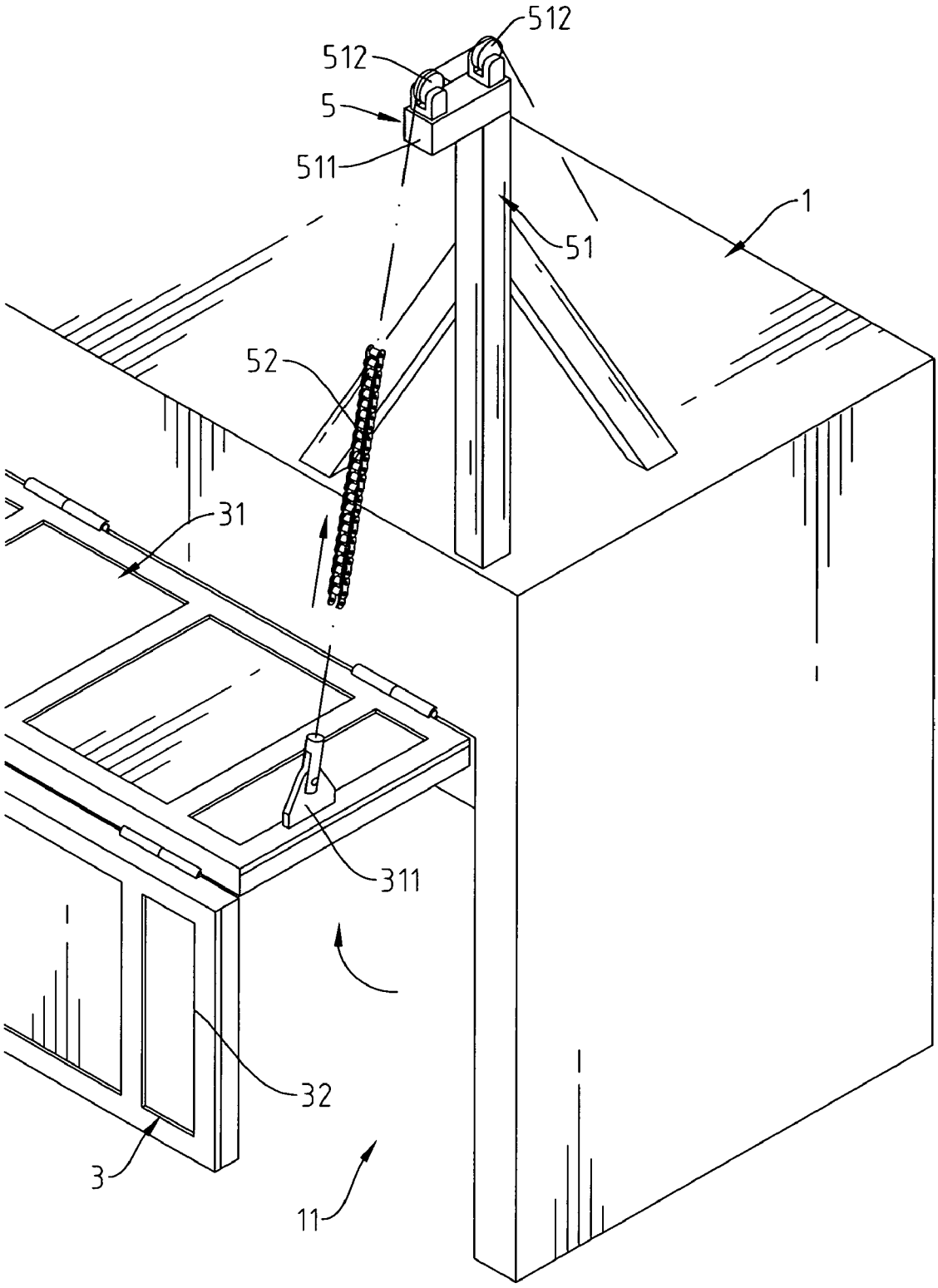
FIG. 6 is a schematic view showing the usage status of a third preferred embodiment of the present invention.

Referring to FIG. 6, a third preferred embodiment of the present invention is shown. A feeding door of a heat treatment furnace comprises a box 1, a starter 5, and a door plank 3. The starter 5 has a support frame 51 and a roller chain 52, wherein the support frame 51 is fixed on the outer lateral of the box 1 corresponding to the door plank 3. In addition, the support frame 51 has a protrudent part 511 protruding forward from the top end thereof. At least a rotation wheel is coupled to the upper portion of the protrudent part 511, wherein in this preferred embodiment, the rotation wheel is a chain wheel 512 for being correspondingly rotated by a linear connection device. In this preferred embodiment, the linear connection device is the roller chain 52, wherein one end of the roller chain 52 is pivotally connected to the protrudent ears 311. The other end of the roller chain 52 is connected to a winding device.

Referring to FIG. 6, the usage status of the third preferred embodiment of the present invention is shown. When in use, a winding device (not shown) is started so as to reach the upward pull motion. The roller chain 52 is utilized to lift up the first door plate 31 by the protrudent ears 311, wherein the first door plate 31 can drive the second door plate 32 to be suspended vertically and then folded inwardly so that the door plank 3 can be opened.

Figure 7:
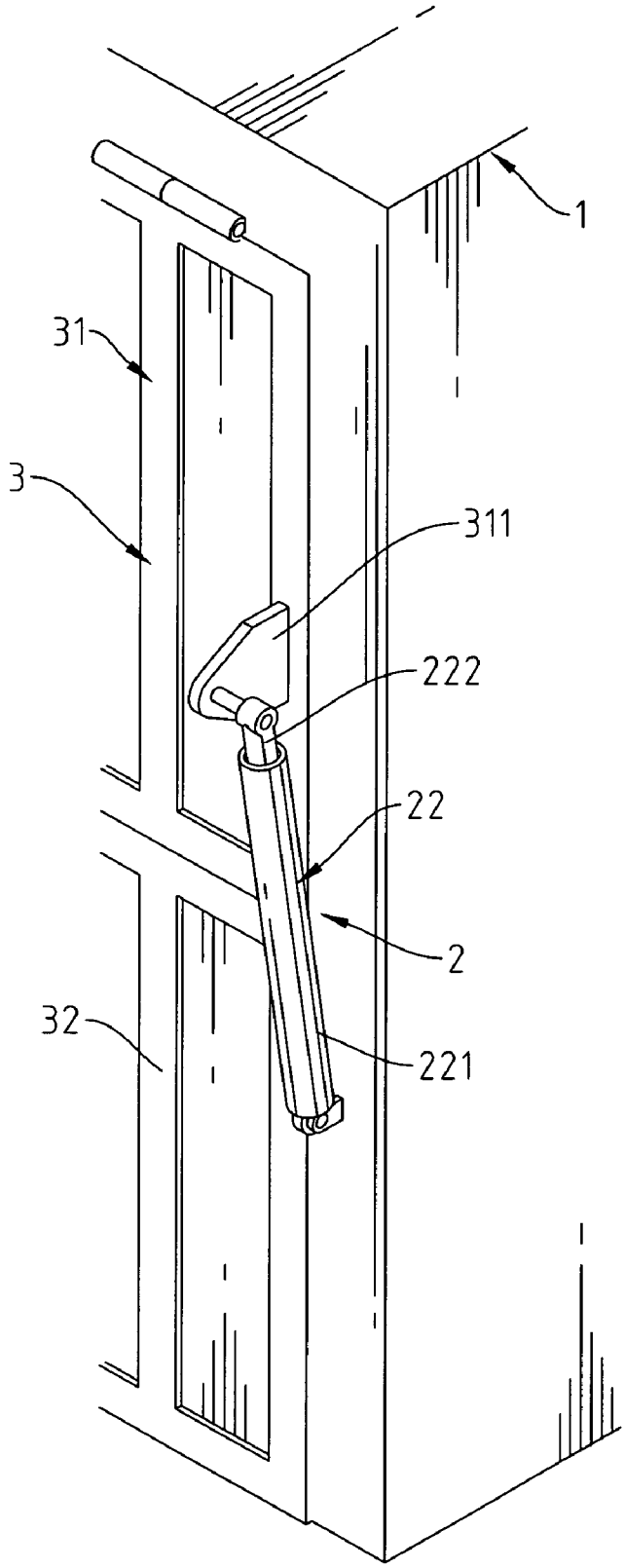
FIG. 7 is a schematic view showing the usage status of the present invention, wherein the starter is mounted on the same side as the door plank.
Figure 8:
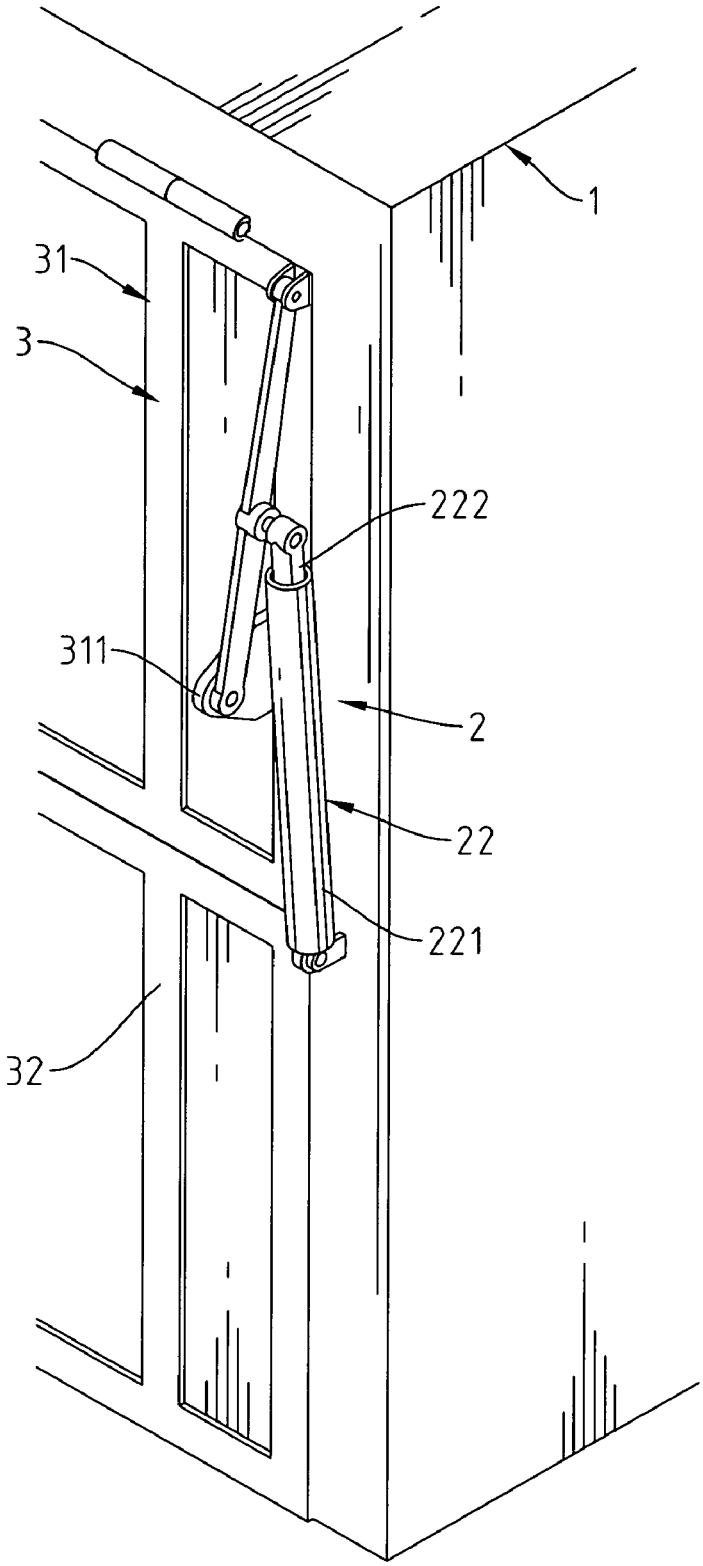
FIG. 8 is a schematic view showing another usage status of the present invention, wherein the starter is mounted on the same side as the door plank.
Figure 9:
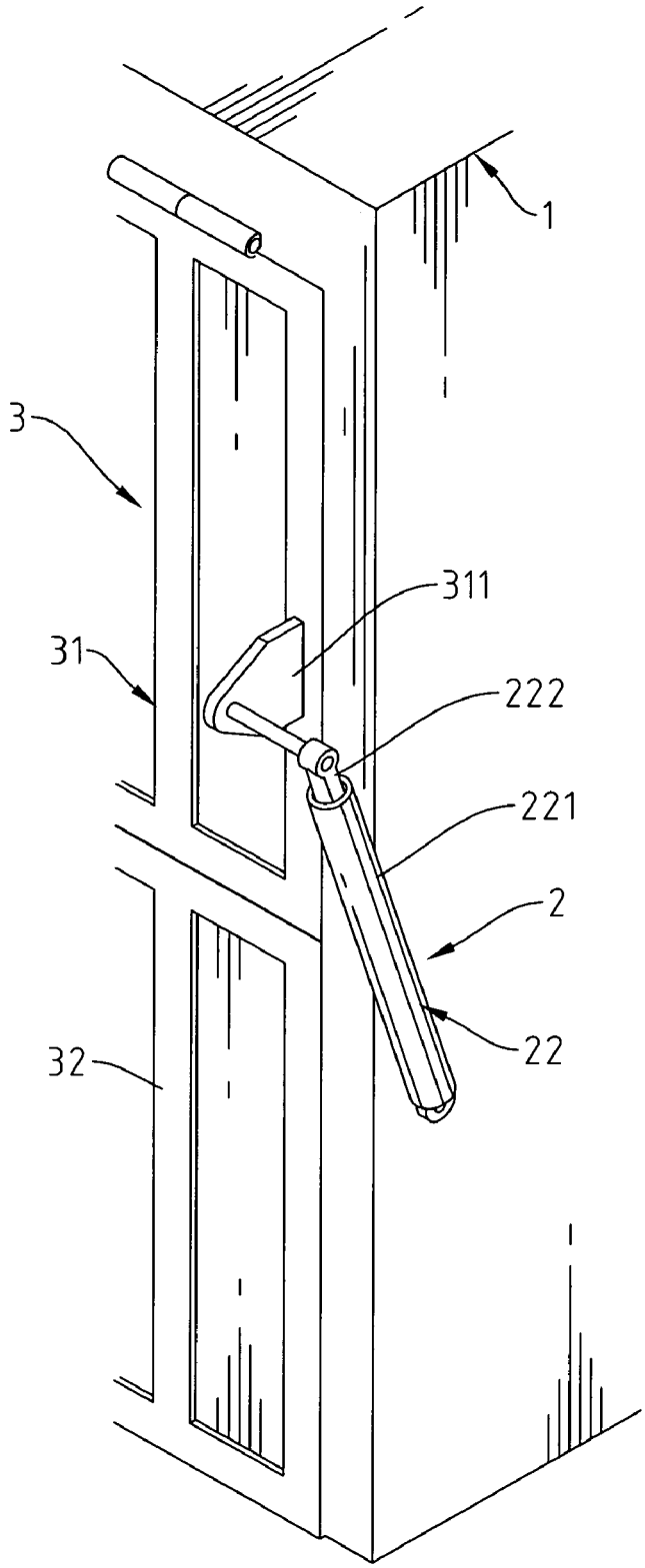
FIG. 9 is a schematic view showing the usage status of the present invention, wherein the starter is mounted on the lateral surface of the door plank.
Figure 10:
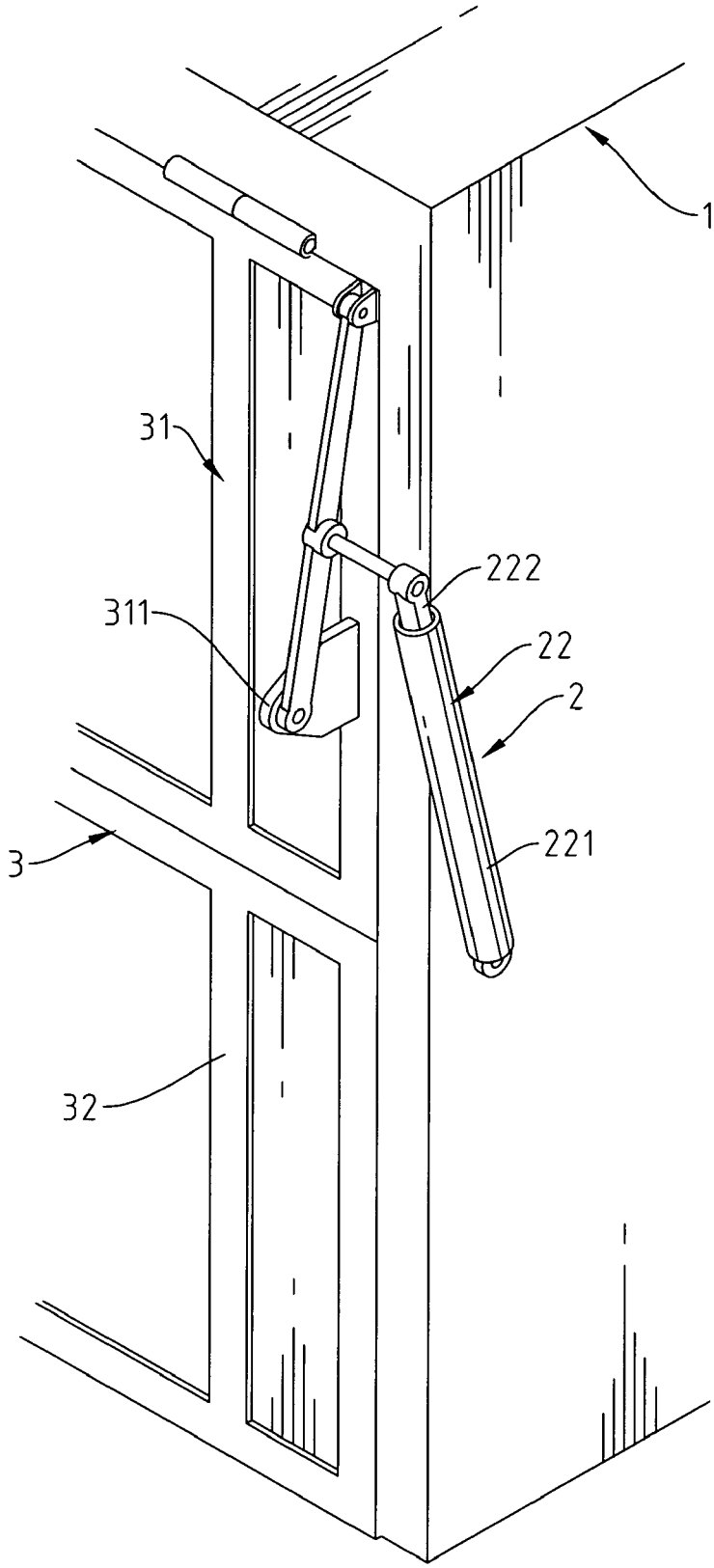
FIG. 10 is a schematic view showing another usage status of the present invention, wherein the starter is mounted on the lateral surface of the door plank.

It is worthy to mention additionally that the starter 2 can be mounted on the outer lateral of the box 1 or other positions in accordance with requirements. Referring to FIG. 7 and FIG. 8, the starter 2 is fixed on the box 1 beside the door plank 3, wherein the starter 2 is mounted on the same side as the door plank 3. This design is applicable to the space deficient in height. Of course the starter 2 can be mounted on the outer later of the box 1, as shown in FIG. 9 and FIG. 10, so as to achieve the same purposes and effects as the aforesaid other preferred embodiments. The related description is omitted herein.

What the invention claimed is:

1. A feeding door of a heat treatment furnace comprising:

a box having a chamber for holding an object that waits for drying, said box having at least a breach;

at least a starter fixed on an outer lateral of said box; and a door plank comprising at least a first and second pivotally coupled door plate joined together by a pivoting connection located between the first door plate and the second door plate, said first door plate is pivotally coupled with said box above said breach, wherein said door plank is upward or downward shifted for being opened or closed, wherein said first door plate includes at least a protrudent ear mounted to a location adjacent a lateral edge in a position underlying said starter, wherein said starter is linked to said protrudent ear to lift said first door plate, said entire second door plate being lifted upwards and away from said box by said pivoting connection, when said first door plate is lifted, wherein the second door plate is configured to swing freely from said pivoting connection.

2. A feeding door of a heat treatment furnace of claim 1, wherein said starter has a hydraulic cylinder for connection with said box via one end and for connection with said door plank via the other end so as to upward or downward shift said door plank by an adjustable rod of said hydraulic cylinder.

3. A feeding door of a heat treatment furnace of claim 1, wherein said starter is fixed on said box beside said door plank and on the same side as the door plank.

4. A feeding door of a heat treatment furnace of claim 1, wherein said starter has a support frame and a steel rope, said support frame is fixed on said outer lateral of said box corresponding to said door plank, at least a rotation wheel is connected to an upper portion of said support frame, said rotation wheel is rotated by a linear connection device, and one end of said linear connection device is connected to said door plank.

* * * * *